US005203513A

United States Patent [19]

Keller et al.

[11] Patent Number: 5,203,513

[45] Date of Patent: Apr. 20, 1993

[54] WEAR-RESISTANT SURFACE ARMORING FOR THE ROLLERS OF ROLLER MACHINES, PARTICULARLY HIGH-PRESSURE ROLLER PRESSES

[75] Inventors: Guenter Keller, Bergisch Gladbach; Jakob Ansen; Albrecht Wolter, both of Cologne, all, Fed. Rep. of Germany

[73] Assignee: Kloeckner-Humboldt-Deutz Aktiengesellschaft, Fed. Rep. of Germany

[21] Appl. No.: 657,992

[22] Filed: Feb. 20, 1991

[30] Foreign Application Priority Data

Feb. 22, 1990 [DE] Fed. Rep. of Germany ..... 4005553
Nov. 13, 1990 [DE] Fed. Rep. of Germany ..... 4036040

[51] Int. Cl.[5] ..... B02C 4/30

[52] U.S. Cl. ..... 241/30; 241/235; 241/293; 241/300

[58] Field of Search ..... 241/275, 300, 30, 293, 241/294, 295, 275, 197, 194; 29/121.1, 121.4

[56] References Cited

U.S. PATENT DOCUMENTS 679,821 8/1901 Arnold ..... 241/295 X
2,637,502 5/1953 Bond ..... 241/194
3,418,925 12/1968 Wiggins ..... 29/121.5 X
4,114,322 9/1978 Greenspan ..... 241/293 X
4,357,287 11/1982 Schonert .
4,597,277 7/1986 Esmieu ..... 29/121.5 X
4,703,897 11/1987 Beisner et al. .
4,921,173 5/1990 Bartley ..... 241/275 X

FOREIGN PATENT DOCUMENTS 0084383 4/1983 European Pat. Off. .
908208 2/1954 Fed. Rep. of Germany ..... 241/295
3814433 11/1989 Fed. Rep. of Germany ..... 241/300
578292 6/1946 United Kingdom ..... 241/300

*Primary Examiner*—Mark Rosenbaum
*Attorney, Agent, or Firm*—Hill, Steadman & Simpson

[57] ABSTRACT

A high pressure roller press formed between opposed cylindrical rollers mounted to perform interparticle crushing or product bed comminution in the nip and having pockets in the surface of a size to retain compressed fine grained material which is pressed in the nip with the compressed material in the pockets being retained for full revolutions of the rollers and coacting with hard portions between the pockets to form the product bed comminution against material passing through the nip and drawing material into the nip.

21 Claims, 2 Drawing Sheets

WEAR-RESISTANT SURFACE ARMORING FOR THE ROLLERS OF ROLLER MACHINES, PARTICULARLY HIGH-PRESSURE ROLLER PRESSES

BACKGROUND OF THE INVENTION

The invention relates to an improved mechanism and improved methods for pressing by product bed comminution.

In the operation of roller crushing, a new and unique form of crushing which has been referred to as product bed comminution or interparticle crushing has been discovered such as disclosed in Schoenert U.S. Pat. No. 4,357,287 and Beisner et al U.S. Pat. No. 4,703,897. This art, as described and claimed in these patents, involves an operation wherein the gap width and force applied between the rollers is such that a crushing fineness is attained by the particles entering the nip mutually crushing one another and forming incipient cracks in the grains. This process and this equipment has resulted in new and unforeseen energy conservation with improved crushing.

Accordingly, the present invention relates to improvements in the art of interparticle crushing or product bed comminution to utilize the advantages of the development and to improve on the process to the extent of having improved draw-in qualities in the nip, of protecting the roller surfaces which are exposed to extraordinarily high stressing and wear and to provide an overall improvement.

In roller crushers and roller mills, brittle grinding stock is drawn into the nip between two rotatable rollers rotating in opposite directions. In interparticle crushing, the individual particles of the grinding stock are drawn into the nip by friction crushing one another therein in a product bed comminution and the material is compressed between the roller surfaces with the application of an extremely high pressure such as disclosed in European Patent 0 084 383.

In this operation, the roller surfaces are exposed to extraordinarily high stressing and high wear. An improvement which has been done is to armor the roller surfaces such as welding layers of hard metallic materials of welding beads welded side-by-side onto the base roller. Another structure which has been adopted is that a wear-resistant cladding of cast or rolled material is applied to the base roller to provide a hardened outer surface. These structures, such as the roller armoring, require a time consuming surface layer welding of annular plies or involve helical welding and increase the cost of the machine.

In order to improve the product draw-in capability of the pressing rollers that must draw the product into the nip by friction and compress it, it is known to provide the armored roller jacket with a plurality of profiles having the shape of welding beads arranged V-shaped on the closed hard cylindrical surface in an additional manufacturing step as disclosed in the aforementioned European Patent 0 084 383. In interparticle crushing of especially abrasive materials such as ores, it has been shown that the risk is not excluded that the roller surface will wear relatively quickly during operation due to the creation of trough-shaped erosion or, excavations in the regions between the profiling welding beads that are welded on at a distance from one another.

The closed, hard outside shell of the armored roller jackets can be over-stressed due to the formation of pressure islands in the nip filled with product material to be pressed with high localized point stressing of the rollers. Surface cracks can lead to the progression of cracks into the base roller member and the hard profile parts that are welded onto the roller can be laterally pinched off given a soft underlayer. The risk is thereby present that the outwardly salient, welded-on profiling welding beads can at least partially break off given high point stressing.

FEATURES OF THE INVENTION

An object of the invention is to create a roller armoring that is simple in fabrication-oriented terms, is wear-resistant and has draw-in capability for the rollers of high-pressure roller presses for pressure comminution of granular material.

A further object of the invention is to provide a press roller for interparticle crushing having an armoring which has a high service life with a minimized risk of crack formation despite profiling and has good draw-in capability even given high point stressing.

What is characteristic of the roller armoring of the invention is that the plurality of profiles applied to the roller surface project outwardly from the roller surface with a given height and which are arranged at such a close spacing from one another that the interstices or, pockets between the profiles are filled during operation of the roller press with compressed, fine-grained material which remains lying in the pockets during the roller revolutions. The profiles are in position to retain the material pressed in between them. The compressed, fine-grained material remaining in the pockets between the profiles of the roller surfaces during the roller revolutions can be composed of the material itself that is to be comminuted in the nip of the roller press on the basis of interparticle crushing. The pockets between the profiles of the roller surface, however, can also be filled out in advance with a foreign, compressed fine-grained material, such as a mixture of cement clinker and plaster in the field of construction materials. Or, for example, the pockets can contain highly wear-resistant ceramic material in the field of ores that remains in the pockets. A suitable bonding agent for the purpose of increasing the adhesion of the materials can also be employed for an even more reliable retention of the compressed, wear-resistant materials in the pockets. In any case, the product material pressed into the pockets and remaining there forms an ideal wear protection. This is by contrast to previous surface armorings of rollers which wear with undesired surface erosion.

The spacing from one another of the pockets preferably amounts to less than 40 mm and the projection height forming the pockets in between amounts to more than 5 mm. The ends of the projections can still noticeably project, so that the product draw-in capability of the roller surfaces remains high. The product draw-in capability of the pressing rollers can thereby be further enhanced when neighboring profiles have different heights.

The profiles applied to the roller surface can be composed of ledges that are arranged in an axial roller direction or at an angle of 0° through 90° relative thereto. The profiles can also be composed of a plurality of welded burl pins projecting from the roller surface and are advantageously arranged distributed grid-like on the roller surface such that the spacing between neighboring burl pins is of approximately the same size both within the same row of burl pins as well as to neighboring rows of burl pins. The spacing between the neighboring burl pins is selected of such a size that the compressed product material remains in the pockets between the burl pins during the revolution of the rollers and forms the anti-wear protection. This roller surface armoring comprising the hard, wear-resistant burl pins arranged hedgehog-like over the roller surface is also in the position to dissipate peak stresses as can particularly occur in the region of the narrowest nip of a high-pressure roller press in interparticle crushing. The projecting burl pins transfer forces into the base member of the roller optimally without cracks and without destruction of their surrounding fields with a high service life of the roller armoring deriving therefrom.

If individual profiles or burl pins were to break off during operation of the high-pressure roller press then a simple restoration of the limited, destroyed surfaces of the roller armoring of the invention is possible in a short time by welding or new burl pins. This restoration is significantly simpler and more cost-beneficial than the repair of entire sections of broken or, eroded, interconnected armoring surfaces that had been hitherto necessary. Actually, the pins or projections on the surface of the roller are protected against breakage by the product material embedded in the pockets between the pins.

A further feature is that with the relative resiliency of the material embedded in the pockets combined with the non-resiliency of the rigid pins between the pockets, an improved product bed comminution results. Thus, not only is the operation improved due to better comminution, but the draw-in capabilities at the nip are improved.

While the areas to be filled with resilient pulverulent material are termed pockets, they preferably are continuously surrounded by the pins or islands and are thus held on the surface of the roller. The term pockets is to be understood in this context in the specification and claims.

Other objects, features and advantages will become more apparent with the teaching of the principles of the invention in connection with the disclosure of the preferred embodiment in the specification, claims and drawing, in which:

DESCRIPTION OF THE PREFERRED EMBODIMENTS

Figure 1:
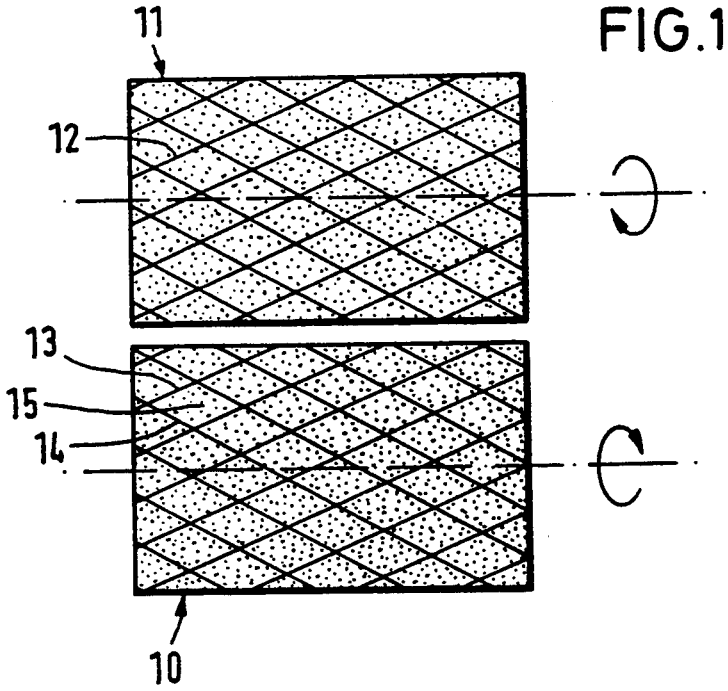
FIG. 1 is a plan view looking down into the nip of a pair of rollers forming a product bed comminution nip therebetween.

In the schematic plan view, FIG. 1 shows a two-roller machine, for a high-pressure roller press for interparticle crushing of granular material. The material is supplied to the nip between a roller 10 and a roller 11 from above via a material delivery stack (not shown). The rollers are mounted in suitable bearing supports with very strong adjustments and very strong support so that the required high pressure nip pressure can be obtained. For that purpose, one roller may be mounted on fixed bearings and the other on movable bearings having means for adjusting the pressure and spacing in the nip which can be accomplished such as by a hydraulic support means for the bearings.

A multitude of outwardly projecting profiles 12, 13, 14 is welded onto the smooth surface of the driven, oppositely rotating rollers 10, 11. These profiles are arranged distributed crossing one another grid-like. The profiles can also be arranged on the roller surface in axial roller direction, or in a V-shape or the like. A plurality of pockets 15 of approximately the same size is formed between the profiles 13, 14. These pockets 15 will fill with the compressed granular material after a short operating time as a consequence of the high pressing force in the region of the narrowest nip. This granular material will remain in the pockets 15 during the roller revolutions due to the comparatively small spacing between neighboring profiles 13, 14. This space is preferably less than 40 mm. A profile height of preferably more than 5 mm is used. The compressed, fine-grained product material embedded into the pockets 15 and remaining there forms an ideal anti-wear protection for the entire roller surface.

Figure 2:
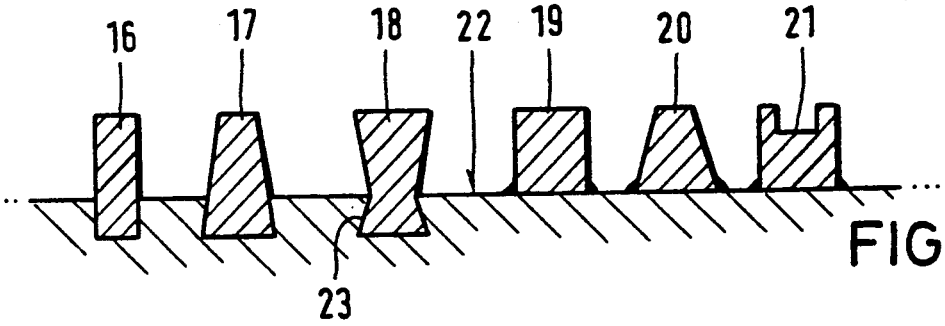
FIG. 2 shows a series of pins or projections such as used on the surface of the rollers with the different projections shown in radial section and the individual projections illustrating different shapes or forms that the projections may assume.

FIG. 2 shows various forms of profile shapes 13, 14 enlarged and in cross-section. The cross-section of the profiles 16 and 19 is rectangular, that of the profiles 17, 18 and 20 is trapezoidal. The profile 21 shown at the far right has an outer surface at its circumference with a crater or recess. It not only has the pockets between the individual profiles but also a recess 21 which helps protect the roller.

The profiles 19, 20, 21 are welded, soldered, or cemented onto the roller surface 22. The profiles 16, 17, 18 are anchored in the material of the roller surface 22, for example on the basis of a dovetail channel joint 23.

What all profiles 16 through 21 have in common is that they are composed of a hard, metallic alloy material that allows the formation of sharp edges that could not be achieved by surface-layer welding beads. In this fashion, the profiles with their sharp edges are extremely wellsuited for durably retaining the fine-grained product material embedded or impressed between the profiles as an anti-wear protection for the roller surface 22. This is especially true of the profile 18 having undercuts. In other words, the profile may have a radial outer dimension greater than its dimension adjacent the surface of the roller so that the compressed material is clearly held onto the surface of the roller between the projections.

Figure 3:
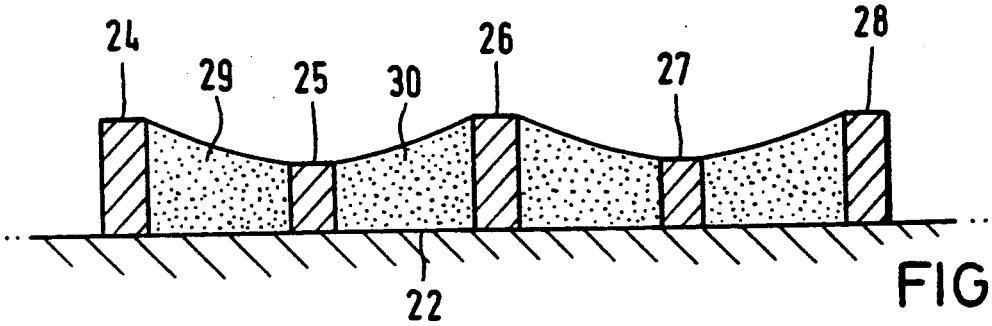
FIG. 3 is a fragmentary radhal section illustrating projections on the surface of a roller where the projections are of different height.

In FIG. 3, the neighboring profiles 24, 25, 26, 27, 28 can have differing heights for enhancing the product draw-in capability of the pressing rollers. The compressed, fine-grained material 29, 30 is embedded in the pockets between the profiles 24 through 28 during operation of the roller press. This forms the anti-wear protection. In case of wear, product material 29, 30 can be subsequently introduced again by simple compressing for the purpose of repair of the rollers.

Figure 4:
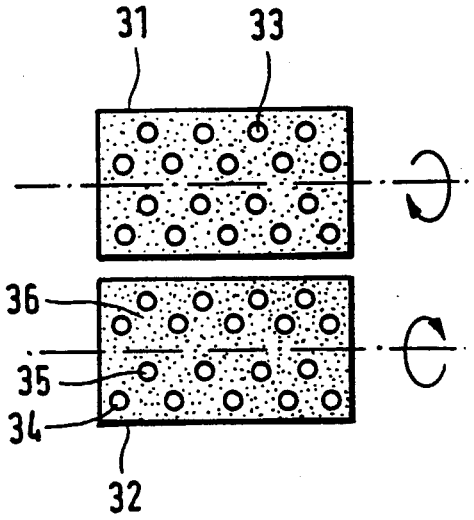
FIG. 4 is a somewhat schematic plan view or a pair of rollers for product bed comminution showing another form of the invention.

According to the exemplary embodiment of FIG. 4, a plurality of outwardly projecting burl pins 33 is welded onto the surface of the rollers 31, 32. The burl pins 33 are welded in a grid pattern such that the rows 34, 35 of burl pins applied along generated roller lines are arranged offset staggered relative to one another. The distance between neighboring burl pins can thereby always be of approximately the same size both in the same row of burl pins as well as in neighboring rows of burl pins.

Pockets 36 are of approximately the same shape and are of the same size relative to one another formed between the individual burl pins. These pockets 36 fill during operation of the roller press upon interparticle crushing of granular material, with product material. The size of these pockets 3 is dimensioned such that the product material remains lying in these pockets 36 during the entire revolution of the rollers 31, 32 for the purpose of the anti-wear protection.

Figure 5:
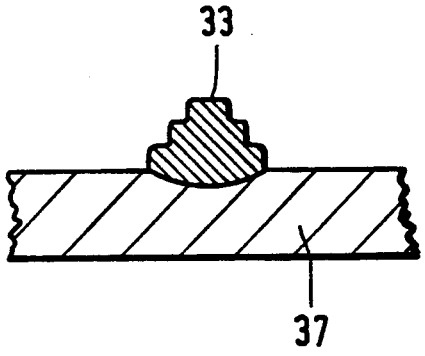
FIG. 5 is a fragmentary vertical section illustrating still another form of projection.

FIG. 5 shows a vertical section through the burl pins 33 of FIG. 4 in their welded-on condition. The substratum of the burl pin 33 as well as of all other burl pins can be composed of an annular band 37 applied on the base roller member and of at least one ply of welding beads welded on side-by-side. In any case, the material of the substratum 37 is selected such that the burl pins 33 or the profiles as well can be easily welded on or can be easily applied with other joining techniques. The burl pins themselves can have a cylindrical, frustum or a pyramidal configuration.

The material of the hard, wear-resistant profiles of FIGS. 1 through 3 as well as of the burl pins 33 of FIGS. 4 and 5 can be composed of a metallic alloy having hard substances, for example carbides or special carbides, and can have a high content of carbon or of chromium. The profiles of FIGS. 1 through 3 as well as the burl pins 33 of FIGS. 4 and 5 can also be composed of hard ceramic material, sintered hard metal or the like. The material of the profiles or burl pins after welding has a core hardness of more than 52 HRC (hardness test according to Rockwell C).

The profiles of FIGS. 1 through 3 as well as the burl pins 33 of FIGS. 4 and 5 have a height of at least approximately 5 mm, for example 10 mm, and a thickness or diameter of at least approximately 8 mm, for example 15 mm, given a roller diameter of at least 500 mm.

The invention can be particularly well-employed for surface armoring of rollers of high-pressure roller presses for interparticle crushing or pressure treatment of ores, even ores containing diamonds that represent especially abrasive materials. The service life of the roller armoring of the invention is long even given such abrasive materials because only the surfaces of the profiles or burl pins which lie radially outward are subject to wear. The remaining regions of the roller surface as well as of the profiles attached thereto are protected against wear by the anti-wear layer built up by itself and composed of compressed product material.

Thus, it will be seen that there has been provided an improved roller for product bed comminution which achieves the aforementioned objectives. The resultant unit is long wearing and is improved in operation in that it has better draw-in capabilities and is fully operative in the product bed compression mode.

We claim as our invention:

1. A high pressure roller press capable of product bed comminution of pulverulent material comprising in combination:

a cylindrical press roller for mounting in opposition to a coacting roller for forming a high pressure product bed comminution nip therebetween;

and pockets on the outer surface of the press roller with rigid projections therebetween and the pockets being of a size to be filled with pulverulent materials being compressed into the pockets;

said pockets capable of retaining the pulverulent material in the pockets for full rotation of the roller so that the compressed pulverulent material in the pockets coacting with the projections comprise means for performing interparticle crushing in the nip, the width of the pockets between projections being less than 40 mm and the depth of the pockets being in excess of 5 mm.

2. A high pressure roller press capable of product bed comminution of pulverulent material constructed in accordance with claim 1:

wherein the projections are constructed so that their side surfaces form ledges arranged to extend in a generally axial direction forming an angle with the axis of the roller with the angle in the range of 0° to 90°.

3. A high pressure roller press capable of product bed comminution of pulverulent material constructed in accordance with claim 1:

wherein said projections have side surfaces that extend in planes which project in a general radial direction relative to an axis of the roller with the planes extending at an angle to the axis of the roller, said planes crossing each other to form a grid.

4. A high pressure roller press capable of product bed comminution of pulverulent material constructed in accordance with claim 1:

wherein the projections are of different radial heights.

5. A high pressure roller press capable of product bed comminution of pulverulent material constructed in accordance with claim 1:

wherein the projections are formed of a hard metal alloy.

6. A high pressure roller press capable of product bed comminution of pulverulent material constructed in accordance with claim 1:

wherein the projections are welded onto a cylindrical surface of the roller.

7. A high pressure roller press capable of product bed comminution of pulverulent material constructed in accordance with claim 1:

wherein the projections have inclined side walls so that the projection has a larger axial dimension at the radial outer edge than inwardly therefrom.

8. A high pressure roller press capable of product bed comminution of pulverulent material constructed in accordance with claim 1:

wherein the projections are tapered so as to have a radial outer dimension smaller than a base of the projection.

9. A high pressure roller press capable of product bed comminution of pulverulent material constructed in accordance with claim 1:

wherein the projections have an outer radial facing surface with an indentation therein.

10. A high pressure roller press capable of product bed comminution of pulverulent material constructed in accordance with claim 1:

including an annular band carried on the base roller with projections supported on said annular band.

11. A high pressure roller press capable of product bed comminution of pulverulent material comprising in combination:

a cylindrical press roller for mounting in opposition to a coacting roller for forming a high pressure product bed comminution nip therebetween;

and pockets on the outer surface of the press roller with rigid projections therebetween and the pockets being of a size to be filled with pulverulent materials being compressed into the pockets;

said pockets capable of retaining the pulverulent material in the pockets for full rotation of the roller so that the compressed pulverulent material in the pockets coacting with the projections performs interparticle crushing in the nip, the width of the pockets between projections being less than 40 mm and the depth of the pockets being in excess of 5 mm; and the projections forming a plurality of radially extending pins defining a nubby surface on the press roller.

12. A high pressure roller press capable of product bed comminution of pulverulent material comprising in combination:

a cylindrical press roller for mounting in opposition to a coacting roller for forming a high pressure product bed comminution nip therebetween;

and pockets on the outer surface of the press roller with rigid projections therebetween and the pockets being of a size to be filled with pulverulent materials being compressed into the pockets;

said pockets capable of retaining the pulverulent material in the pockets for full rotation of the roller so that the compressed pulverulent material in the pockets coating with the projections performs interparticle crushing in the nip, the width of the pockets between projections being less than 40 mm and the depth of the pockets being in excess of 5 mm; and said projections being in the form of pins arranged on the surface of the roller in rows such that the distance between adjacent pins is the same as the distance between rows of pins.

13. A high pressure roller press capable of product bed comminution of pulverulent material comprising in combination:

a cylindrical press roller for mounting in opposition to a coacting roller for forming a high pressure product bed comminution nip therebetween;

and pockets on the outer surface of the press roller with projections therebetween and the pockets being of a size to be filled with pulverulent materials being compressed into the pockets and retain the material in the pockets for full rotation of the roller so that the compressed material coacting with the projections performs interparticle crushing in the nip, the width of the pockets between projections being less than 40 mm and the depth of the pockets being in excess of 5 mm;

said compressed material in the pockets being of a substance different than the material being compressed in the nip.

14. A high pressure roller press capable of product bed comminution of pulverulent material comprising in combination:

a cylindrical press roller for mounting in opposition to a coacting roller for forming a high pressure product bed comminution nip therebetween;

and pockets on the outer surface of the press roller with projections therebetween and the pockets being of a size to be filled with pulverulent materials being compressed into the pockets and retain the material in the pockets for full rotation of the roller so that the compressed material coacting with the projections performs interparticle crushing in the nip, the width of the pockets between projections being less than 40 mm and the depth of the pockets being in excess of 5 mm;

said material compressed in said pockets containing a bonding agent enhancing the adhesion of the material into the pockets.

15. The method of performing product bed comminution pressing comprising the steps:

passing a pulverulent material through a nip formed between opposed cylindrical press rollers;

providing pockets on the surface of at least one of the rollers having a width less than 40 mm and a depth in excess of 5 mm;

are retaining compressed material in the pockets for a full revolution of the roller with pockets retaining material throughout operation so that product bed comminution is performed in the nip by a projection between the pockets coacting with compressed material within the pockets.

16. The method of performing with the steps of claim 15:

wherein the compressed material in the pockets is the same as the material being pressed in the nip.

17. The method of performing product bed comminution pressing in accordance with the steps of claim 15:

wherein the material in the pockets is a material different than the material being compressed in the nip.

18. The method of performing product bed comminution pressing comprising the steps:

passing a pulverulent material through a nip formed between opposed cylindrical press rollers;

providing pockets on the surface of at least one of the rollers having a width less than 40 mm and a depth in excess of 5 mm;

and retaining compressed material in the pockets for a full revolution of the roller with pockets retaining material throughout operation so that product bed comminution is performed in the nip by a projection between the pockets coacting with compressed material within the pockets;

the compressed material in the pockets being carried in a depth of in excess of 5 mm.

19. The method of performing product bed comminution pressing comprising the steps:

passing a pulverulent material through a nip formed between opposed cylindrical press rollers;

providing pockets on the surface of at least one of the rollers having a width less than 40 mm and a depth in excess of 5 mm;

and retaining compressed material in the pockets for a full revolution of the roller with pockets retaining material throughout operation so that product bed comminution is performed in the nip by a projection between the pockets coacting with compressed material within the pockets;

the material carried in the pockets having the width of the pockets which is less than 40 mm.

20. A high pressure roller press capable of product bed comminution of pulverulent material comprising in combination:

a press having opposed cylindrical rollers mounted for rotation in opposite direction and defining a high pressure pressing nip therebetween capable of product bed comminution;

and a plurality of pockets on the outer surface of each of the rollers of a size to retain the pulverulent material passed through the nip for a full revolution of the rollers so that the material subjected to product bed comminution in the nip is compressed by a coaction of hard material between the pockets and the softer compressed material within the pockets forming interparticle crushing in the nip, the width of the pockets between projections being less than 40 mm and the depth of the pockets being in excess of 5 mm.

21. A high pressure roller press capable of product bed comminution of pulverulent material constructed in accordance with claim 20:

wherein the pockets are filled with an air-resistant resilient material bonded in the pockets.

* * * * *